United States Patent [19]

Watson

[11] 4,041,433

[45] Aug. 9, 1977

[54] VENTED THERMOSTAT

[75] Inventor: Wayne T. Watson, Mansfield, Ohio

[73] Assignee: Therm-O-Disc, Incorporated, Mansfield, Ohio

[21] Appl. No.: 682,745

[22] Filed: May 3, 1976

[51] Int. Cl.[2] ..... H01H 61/00; H01H 71/02

[52] U.S. Cl. ..... 337/112; 219/328; 337/328; 337/380

[58] Field of Search ..... 337/327, 328, 343, 348, 337/375, 380, 381, 112, 374; 219/328, 331

[56] References Cited

U.S. PATENT DOCUMENTS

| | | | |
|---|---|---|---|
| 2,507,365 | 5/1950 | Boddy | 337/374 |
| 3,435,189 | 3/1969 | Manecke | 337/348 X |
| 3,715,567 | 2/1973 | Mandziak | 219/328 X |
| 4,000,396 | 12/1976 | Abel, Jr. | 219/328 X |

*Primary Examiner*—Robert J. Hickey

*Attorney, Agent, or Firm*—McNenny, Pearne, Gordon, Gail, Dickinson & Schiller

[57] ABSTRACT

A thermostatically controlled system is disclosed in which the thermostat is exposed to a zone of high moisture content. In order to prevent the accumulation of moisture within the thermostat which could cause tracking failures or over pressure failures in the device a vent opening is provided which vents the interior of the thermostat to a zone of low moisture content. The vent prevents the occurrence of vacuum within the thermostat and thereby eliminates the pumping of moisture into the thermostat from the zone of high moisture content. Also the vent allows for the escape of any moisture which might penetrate into the thermostat interior.

7 Claims, 2 Drawing Figures

VENTED THERMOSTAT

BACKGROUND OF THE INVENTION

This invention relates generally to thermostatically controlled systems and more particularly to such systems in which the thermostat control must function at least partially in a highly moist environment.

PRIOR ART

Thermostat controls are often required to control the operation of an appliance heater. For example, in the coffee maker marketed under the name "Mr. Coffee" a relatively high rated resistance heater is immersed in water to rapidly heat such water. In such system a bimetal snap disc thermostat is located adjacent to such heater to shut the heater off when water is no longer present to absorb the heat generated by the heater and the control thereby prevents damaging over temperature in the device. In such system the thermostat is mounted in an elastomeric ring with the face of the disc cup exposed directly to the moisture zone. In addition a metallic strap extends between the heater and the face of the disc cup to serve as a heat flow conduction path so that the thermostat will respond quickly to the rise in temperature experienced when the water is no longer present.

In systems of such type problems have been encountered in some instances because water has collected within the thermostat. In some instances the water has caused shorts to develop when the moisture caused electrical tracking along the surface of the body. Further, when very rapid heating of the thermostat occurs the moisture in a device has caused a build up of damaging pressure within the device.

In such system the moisture has entered the thermostat through the joint between the disc cup and the switch body. Attempts to seal such joint with epoxy type coatings or the like and with the elastomeric ring in which the thermostat has been mounted have not solved the problem. It appears that in such system water tends to collect along the joint between the disc cup and body and when the device cools a vacuum is developed within the control which draws water into the switch cavity. The water then produces the problems mentioned above.

Additional prior art includes thermostats of the general type disclosed in the Odson U.S. Pat. No. 3,259,720, assigned to assignee of the present invention. Such devices include a switch body and a disc cap which cooperate to define the interior cavity or cavities of the thermostat. A joint exists between such body and cap. In addition the interior of the device communicates with the exterior along an opening in the switch body through which the manual reset members extend. Since there is no provision for a seal between the opening and the manual reset member, such opening allows relatively free flow of the environmental fluid between the interior and the exterior of the device.

SUMMARY OF THE INVENTION

In accordance with the present invention a novel and improved thermostatic controlled system is provided in which the thermostat is mounted so that a portion of the thermostat is exposed to the high moisture zone and the thermostat is positively vented to a zone within the system having relatively low moisture content. The vent maintains the interior of the thermostat at substantially the same pressure as the pressure existing around the joint between the disc cup and body proper. Therefore differential pressures cannot occur across such joint to produce a pumping action and consequently the tendency of the moisture to penetrate through the joint is substantially reduced. Further, the vent provides for the free escape of any moisture which might penetrate into the thermostat interior.

In such system the failure experienced in the prior art systems are eliminated without increasing the cost of the device or of the system in which the device is installed. In accordance with the principal embodiment disclosed the thermostat is formed with a centrally located vent opening in the switch body, which opening is directly open to a zone within the systems which is not subjected to high moisture content. In an alternate embodiment passage means are provided to extend the vent from the thermostat body to a zone in which low moisture content exists even if the entire environment immediately around the thermostat is subject to high moisture conditions.

The thermostat in accordance with the present invention is provided with a sufficiently good seal to prevent free access of moisture into the thermostat even through the thermostat combination is arranged to allow moisture which might collect within the device to escape.

BRIEF DESCRIPTION OF THE DRAWINGS

FIG. 1 is a fragmentary cross section of a thermostatically controlled system incorporating the present invention of a type which is often used in an automatic coffee maker or the like.

DETAILED DESCRIPTION OF THE DRAWINGS

Figure 1:
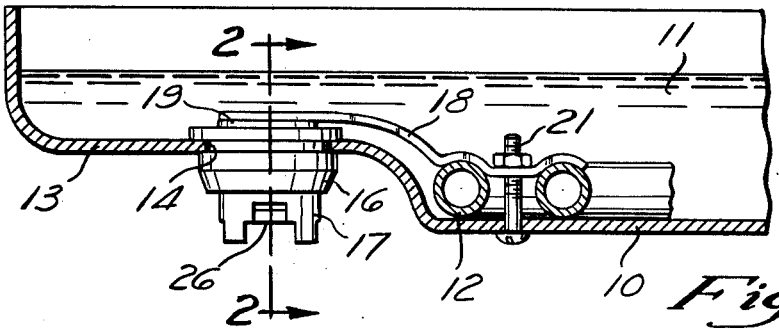

FIG. 1 illustrates a system incorporating this invention which includes an open container 10 for water or other liguid 11 and a resistance heater 12 which operates to heat the water 11 within the container. Such container may be used, for example, in a drip type coffee maker of the type marketed under the trade name "Mr. Coffee."

In the illustrated embodiment the container is provided with a lateral portion 13 providing an aperture 14 in which an elastomeric seal ring 16 is mounted. Extending up through the seal ring 16 is a bimetal snap disc thermostat 17 which is connected in the circuit of the heater 12 and operates to shut the heater off when the thermostat 17 senses a predetermined high temperature higher than the temperature encountered when the water 11 is present in the container 10.

In the illustrated embodiment a metallic strap 18 is welded at one end to the disc cup 19 of the thermostat 17 and is connected at its other end to the heater 12 by a bolt fastener 21. When sufficient water 11 is present in the container 10 to cover the strap 18 between the heater 12 and the thermostat 17, the section of the strap between the heater and thermostat is cooled by the water a sufficient amount to prevent the strap from conducting sufficient heat to the thermostat to cause thermostat operation. In practice the operating temperature of the thermostat is selected to be higher than the maximum temperature of the water 10 within the container. In this system the thermostat therefore remains closed so long as sufficient water is contained within the container to prevent substantial flow of heat along the strap 18 between the heater and the thermostat. This condition exists even when the temperature of the heater itself exceeds the temperature of the water by substantial amounts because of the cooling effect of the water on the strap.

In such devices the heaters 12 are provided with substantial capacity so that the water in the container is rapidly heated to the desired temperature. In addition the container is provided with outlet means (not illustrated) which allows the heated water to flow out of the container into the remaining portion of the system in which the coffee is actually brewed.

Such devices are usually arranged so that only a limited amount of water is available for heating, i.e., the amount necessary to brew one pot of coffee and as the heating occurs and the flow of the water progresses out of the container the level of the water drops down until the portion of the strap 18 between the heater 12 and the thermostat is no longer covered with water. When this condition occurs the heat applied to the strap by the heater causes a rapid increase in the temperature of the strap and a rapid flow of heat along the strap to the disc cap 19. This causes a rapid increase in the temperature sensed by the thermostat. Consequently, the temperature of the thermostat is quickly elevated to the operating temperature in response to the lowering of the level of the water within the container. Therefore, the thermostat operates to shut the heater off and prevent excessive overriding in the system.

In such system because a high output heater is utilized, it is important the thermostat respond very quickly to prevent damaging over temperatures from occurring when the water is no longer present to absorb the heat generated by the heater.

Figure 2:
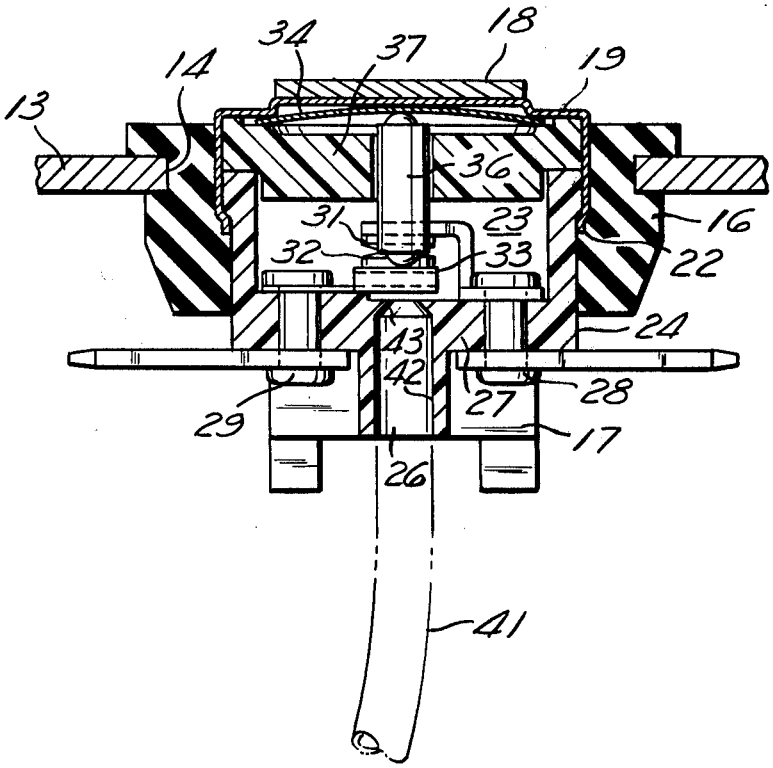
FIG. 2 is an enlarged cross section of the thermostat and its immediate environment.

Devices as thus far described have been manufactured and sold and constitute prior art with respect to the invention. In such prior art system, however, difficulty has been encountered in some instances. Even though the elastomeric ring 16 is formed to closely fit the disc cap 19, water has penetrated down along the disc cap within the ring 16 to the area of a joint 22 illustrated in FIG. 2. This apparently occurs due to the extreme temperature fluctuations which are encountered even though the ring 16 is formed with the intention of providing a substantial seal between the thermostat and the inner wall of the ring. Such water then penetrates the joint at 22 and flows up along the joint 22 into the interior cavity 23 of the thermostat where it collects.

In some instances when the water collects within the interior cavity 23 of the thermostat it causes a failure known in the trade as tracking in which a resistance path is developed by the moisture along the surface of the thermostat body between the terminals. Such resistant path causes current flow between the thermostat terminals and tends to produce a track along the thermostat body of progressively lower resistance which ultimately causes the device to fail by shorting out.

In some instances in the prior art devices in which relatively rapid exhaust along the joint 22 cannot occur the collection of the moisture within the interior cavity 23 first produced a tracking type failure which caused a rapid increase in the heat within the thermostat. This caused a rapid vaporization of the moisture within the cavity and excessive pressures which could not escape rapidly enough to prevent a pressure failure of the device.

In order to overcome the problem of accumulation of moisture within the interior of the thermostat, attempts have been made to produce a sufficiently good seal along the joint 22 to prevent the entry of moisture even when a vacuum occurs within the cavity due to the cooling of the thermostat. Such attempts have involved applying a sealant coating, such as epoxy, to the joint area to provide a complete seal. Such coatings, however, although they provide a relatively good seal tend to deteriorate due to the thermal contraction and expansion of the parts and even devices with such coatings have encountered failures.

The problem encountered in the prior art has been overcome by the present invention in which the switch body of the thermostat 24 is formed with an atmospheric vent opening 26. In the illustrated embodiment the switch body is generally cylindrical in shape and is provided with a lower end wall 27 through which the terminal connections 28 and 29 extend. These terminals connect to a stationary contact 31 and a movable contact 32 respectively. The movable contact is carried by a flexible arm 33 and is maintained in engagement with a fixed contact 31 to provide an electrical connection between the two terminals 28 and 29 when a bimetal snap disc 34 is in the position illustrated in FIG. 2.

Positioned between the snap disc 34 and the movable arm 33 is a bumper 36 guided in a bumper guide disc 37 which functions to move the movable contact 32 away from the fixed contact 31 when the snap disc reaches its operating condition and snaps through to its opposite position, a curvature. This disconnects the two terminals 28 and 29 and functions to terminate the operation of the heater.

The vent opening 26 extends along the axis of the body 34 from the exterior of the device to the interior cavity 23 of the thermostat and functions to maintain the interior cavity 23 at atmospheric pressure even when the temperature of the thermostat increases and decreases. Consequently, the vent passage 26 prevents the occurrence of a vacuum within the chamber 23 which could tend to pump moisture or vapor into the chamber 23 along the joint 22. Further, even if a small amount of moisture or vapor penetrates the joint 22 such moisture either in the form of liquid or vapor exhausts from the chamber 23 through the vent so that moisture cannot accumulate in the chamber 23.

During actual tests it has been determined that the vent passage 26 functions to prevent and eliminate the failures in prior art discussed above. It should be noted that the vent opening 26 in order to properly function should communicate with a zone within the system of relatively low moisture content so that moisture does not enter the vent and collect in the device.

In the illustrated embodiment the vent opening communicates with the zone within the system below the container where a high moisture content does not exist. However, in some systems in which the entire environment immediately surrounding the thermostat contains a high moisture content, either in the liquid or vapor state, a conduit 41 (illustrated in phantom in FIG. 2) is inserted into the vent opening 26 to provide communication for venting purposes with a remote location which does not contain a high moisture content.

The vent opening 26 is preferably shaped with first radius 42 extending from the open end thereof to a conical section 43 adjacent to the inner end which provides a shoulder against which the tube 41 can be seated when it is inserted into the vent opening. Such shoulder insures that the tube 41 cannot be extended into the device a sufficient distance to cause engagement with the switch parts of the device and also insures that the tube does not produce a raised shoulder along the lower wall of the interior cavity to limit or resist flow of liquid out of the device.

In the preferred embodiment the vent opening 26 is located in the lower most part of the cavity 23 to insure that liquid does not collect within the device even if such liquid penetrates through the joint 22. Preferably the joint 22 formed between the switch body and the disc cap is such that a sufficiently good seal is provided to prevent significant flow of liquid or vapor into the interior of the thermostat so long as a pressure differential does not occur across the joint. Such joint, however, is not sufficiently well sealed at least after the continued cycling of the device to prevent flow through the joint responsive to pressure differential. In other words, the joint is not provided with a hermetic seal but is sufficiently tight to prevent any appreciable flow of moisture into the cavity 23.

With the illustrated embodiment the problems discussed above experienced in the prior art have been eliminated without any increase in cost of the device, in fact the solution to the problem results in material savings in that the material required to form the switch body 24 is reduced compared to devices without the vent opening. Consequently, the solution to the problem also results in reduced manufacturing costs in most instances.

Although preferred embodiments of this invention are illustrated it is to be understood that various modifications and rearrangements may be resorted to without departing from the scope of the invention disclosed and claimed.

What is claimed is:

1. In combination a device having a first zone of high moisture content and a second zone of reduced moisture content and a thermostatic control for said device, said thermostat including a body assembly having two parts with a joint therebetween, said joint being substantially sealed against free flow of moisture therethrough but permitting limited flow when pressure differentials occur across said joint, said joint being in communication with said first zone, said body assembly including a vent isolated from said first zone and communicating with said second zone, said vent preventing pressure differentials from occurring across said joint.

2. A combination as set forth in claim 1 wherein said thermostat is a bimetal snap disc thermostat having a switch body and a disc cap, and said joint is between said body and disc cap.

3. A combination as set forth in claim 1 wherein said device includes a wall separating said first and second zones, an elastomeric member mounted in said wall, and said thermostat is positioned in said elastomeric member with a close fit, said elastomeric member extending across said joint whereby moisture tends to collect in the zone of said joint.

4. A combination as set forth in claim 3 wherein said joint is coated with a sealant such as an epoxy or the like.

5. A combination as set forth in claim 1 wherein said vent is open to the lower portion of the interior of said body assembly.

6. A combination as set forth in claim 5 wherein said body assembly is generally cylindrical and said vent extends generally along the axis of said body assembly.

7. A bimetal snap disc thermostat comprising a switch body, a disc cap cooperating with said switch body to define a switch cavity closed along the joint therebetween, a mounting for said thermostat tending to cause moisture to collect along said joint, said joint being provided with a sufficiently good seal to prevent material flow of moisture therethrough when a pressure differential does not exist across said joint, and a vent open to said switch cavity from a substantially dry location operable to prevent a pressure differential from occurring across said joint and allowing escape of moisture from said switch chamber.

* * * * *